US006382195B1

(12) United States Patent
Green et al.

(10) Patent No.: US 6,382,195 B1
(45) Date of Patent: May 7, 2002

(54) EXHAUST GAS RECIRCULATION SYSTEM FOR AN INTERNAL COMBUSTION ENGINE HAVING AN INTEGRATED VALVE POSITION SENSOR

(75) Inventors: John C. Green, Sterling Heights; Robert J. Telep, Livonia; Mark Osterbrink, St. Clair Shores, all of MI (US)

(73) Assignee: BorgWarner Inc., Troy, MI (US)

( * ) Notice: Subject to any disclaimer, the term of this patent is extended or adjusted under 35 U.S.C. 154(b) by 0 days.

(21) Appl. No.: 09/507,201

(22) Filed: Feb. 18, 2000

(51) Int. Cl.[7] ..... F02M 25/07
(52) U.S. Cl. ..... 123/568.23
(58) Field of Search ..... 123/568.23, 568.24; 251/129.11

(56) References Cited

U.S. PATENT DOCUMENTS

| | | | | |
|---|---|---|---|---|
| 3,557,762 A | * | 1/1971 | Mitchell | 123/337 |
| 3,981,284 A | | 9/1976 | Gospodar | |
| 4,146,000 A | | 3/1979 | Hattori et al. | |
| 4,280,471 A | * | 7/1981 | Masaki | 123/568.23 |
| 4,291,535 A | | 9/1981 | Goloff | 60/602 |
| 4,473,056 A | | 9/1984 | Ishida et al. | |
| 4,549,446 A | | 10/1985 | Beeson | |
| 4,556,038 A | | 12/1985 | Okamoto et al. | 123/564 |
| 4,656,834 A | | 4/1987 | Elpern | 60/602 |
| 4,660,382 A | | 4/1987 | Ueno et al. | 60/602 |

(List continued on next page.)

FOREIGN PATENT DOCUMENTS

| | | |
|---|---|---|
| DE | 3005108 | 8/1981 |
| DE | 3606944 | 9/1987 |
| JP | 59-168222 | 9/1984 |
| JP | 60-53622 | 3/1985 |
| JP | 60-259724 | 12/1985 |
| JP | 61-28720 | 2/1986 |
| JP | 61-38123 | 2/1986 |
| JP | 61-212630 | 9/1986 |
| JP | 63-29026 | 2/1988 |
| JP | 3-105022 | 1/1991 |
| JP | 3-88919 | 4/1991 |
| JP | 3-182630 | 8/1991 |
| JP | 5-171946 | 7/1993 |
| JP | 6-221174 | 9/1994 |

*Primary Examiner*—Henry C. Yuen
*Assistant Examiner*—Arnold Castro
(74) *Attorney, Agent, or Firm*—Bliss, McGlynn, P.C.; Greg Dziegielewski

(57) ABSTRACT

An exhaust gas recirculation system includes a valve body having an exhaust port adapted for fluid communication with a source of exhaust gas, an intake port adapted for fluid communication with the intake manifold of an internal combustion engine, and a valve member. The system further includes a drive member mounted to the valve body and including a mechanical output which is rotatable in opposed first and second directions. A gear train is operatively disposed between and in engagement with the rotatable mechanical output of the drive member and the valve member. More specifically, the mechanical output rotating in either of the first or second directions imparts linear, reciprocal motion directly to the valve member through the gear train thereby moving the valve member between opened and closed positions to control the flow of exhaust gas from the exhaust port to the intake port. In addition, the exhaust gas recirculation system further includes a sensor integrated into the valve body and operatively connected to the valve member for detecting the linear position of the valve member as it is reciprocated between its open and closed positions.

8 Claims, 6 Drawing Sheets

U.S. PATENT DOCUMENTS

| | | | | | |
|---|---|---|---|---|---|
| 4,690,119 | A | | 9/1987 | Makino et al. | |
| 4,691,521 | A | | 9/1987 | Hirabayashi et al. | 60/602 |
| 4,779,423 | A | | 10/1988 | Szczupak | 60/602 |
| 4,836,963 | A | | 6/1989 | Gilman, Jr. | 264/45.7 |
| 5,031,406 | A | | 7/1991 | Akiyama | 60/602 |
| 5,036,669 | A | | 8/1991 | Earleson et al. | 60/602 |
| 5,123,246 | A | | 6/1992 | Younessi et al. | 60/602 |
| 5,150,696 | A | | 9/1992 | Kabasin et al. | |
| 5,417,068 | A | | 5/1995 | Olofsson | 60/605.1 |
| 5,477,840 | A | | 12/1995 | Neumann | 123/564 |
| 5,588,403 | A | * | 12/1996 | Williams | 251/129.11 |
| 5,606,957 | A | | 3/1997 | Feucht | |
| 5,701,741 | A | | 12/1997 | Halsall | 60/602 |
| 5,778,674 | A | | 7/1998 | Kimura | 60/600 |
| 5,937,835 | A | * | 8/1999 | Turner et al. | 123/568.24 |
| 6,070,852 | A | * | 6/2000 | McDonnell et al. | 251/129.11 |
| 6,102,016 | A | * | 8/2000 | Sitar et al. | 123/568.23 |

* cited by examiner 258
284
258
288
6A
280
277
280
284
286
296
290
292
6A
275
297
310
278
X
259
274
282
276
303
306
260
275
277
304
300
307
305
259
250
270
268
A'
264
252
254
266
272
312
308

EXHAUST GAS RECIRCULATION SYSTEM FOR AN INTERNAL COMBUSTION ENGINE HAVING AN INTEGRATED VALVE POSITION SENSOR

BACKGROUND OF THE INVENTION

1. Field of the Invention

The present invention relates, generally, to exhaust gas recirculation systems for internal combustion engines and, more specifically, to an improved exhaust gas recirculation system having an integrated valve position sensor.

2. Description of the Related Art

Exhaust gas recirculation (EGR) valves are employed to control the recirculation of a portion of the exhaust gas generated from an internal combustion engine flowing through the exhaust manifold back into the combustion chamber via the intake manifold. Recirculation of exhaust gases to the air/fuel mixture at the intake of the internal combustion engine is conducive to the reduction of the concentration of noxious nitrogen oxides in the exhaust gases which are discharged from the engine. Accordingly, and for this reason, exhaust gas recirculation is effected typically on gasoline engines when the engine is operating under part-throttle or substantial-throttle conditions. More specifically, during idling conditions, negligible amounts of nitrogen oxides are produced in the combustion chambers of the engine and, therefore, there is little or no need of recirculating exhaust gases to the air/fuel mixture. On the other hand, under part-throttle or substantial-throttle conditions, the throttle valve which controls intake air to the internal combustion engine is held in a more open position so that sufficient air may be add mixed to the fuel. At the same time, and during these operating conditions, it is common to recirculate exhaust gases into the air/fuel mixture and thereby reduce the noxious emissions of the internal combustion engine.

Diesel engines typically utilize EGR during no load (idle) through medium load. In virtually all cases, gasoline and diesel, EGR is shut off as full-load conditions are approved.

The operation of the EGR valve and thus the amount of exhaust gas recirculated is often controlled by an electrically actuated vacuum regulator (EVR) as well as a differential pressure sensor, also known as a delta pressure sensor. In turn, signals to and from these components are controlled by an engine control module (ECM). The effective control and simultaneous coordination of the various EGR components presents some difficult challenges. More specifically, it is important to precisely actuate the EGR valve so that $NO_x$, emissions may be optimally minimized. The more components employed to effectively implement exhaust gas recirculation the longer is the system response time and the more difficult and costly it is to control the process. In the related art, the EGR valve, EVR and delta pressure sensor are typically separate components mounted at various places on the engine and interconnected via flexible or hard conduits referred to as "onboard plumbing." In systems presently employed in the related art, each component often requires its own mounting strategy and associated fasteners. The on-board plumbing must be routed so as not to clutter the engine. This object is not always met and EGR systems presently used in the field today can be difficult and expensive to service. Further, and because of the ever shrinking space available for the vehicle power plant, the effective use of space through efficient component packaging is a parameter which designers must constantly seek to improve.

Thus, there is a need in the art for exhaust gas recirculation systems which reduce the number of components needed to effectively recirculate exhaust gas to the air/fuel mixture. Further, there is a need for such a system that reduces the complicated on-board plumbing of the type required for vacuum actuated EGR systems. There is also a need in the art for an exhaust gas recirculation system that is easy and inexpensive to service in the field. Finally, there is a need in the art for an exhaust gas recirculation system which has improved response time and accurate repeatability and which is smaller than present systems employed in the related art.

SUMMARY OF THE INVENTION

The deficiencies in the related art are overcome by an exhaust gas recirculation system for an internal combustion engine of the present invention. The exhaust gas recirculation system includes a valve body having an exhaust port adapted for fluid communication with a source of exhaust gas, an intake port adapted for fluid communication with the intake manifold of an internal combustion engine, and a valve member. The system further includes a drive member mounted to the valve body and including a mechanical output which is rotatable in opposed first and second directions. A gear train is operatively disposed between and in meshing engagement with the rotatable mechanical output of the drive member and the valve member. More specifically, the mechanical output is rotatable in either of the first or second directions to impart linear, reciprocal motion directly to the valve member through the gear train thereby moving the valve member between opened and closed positions to control the flow of exhaust gas from the exhaust port to the intake port. In addition, the exhaust gas recirculation system further includes a sensor integrated into the valve body and operatively connected to the valve member for detecting the linear position of the valve member as it is reciprocated between its open and closed positions.

The exhaust gas recirculation system of the present invention results in elimination of a number of components found in conventional EGR systems. For example, there is no need for a vacuum regulator, diaphragm used to actuate a valve member, pressure sensor employed to sense the difference in pressure between the diaphragm and the intake manifold as well as no need for the associated on-board plumbing typically employed in connection with vacuum actuated EGR systems in the related art. Furthermore, the exhaust gas recirculation system of the present invention enjoys a much faster response when compared to vacuum actuated EGR valves and has very precise valve positioning capabilities which are highly repeatable. In addition, the exhaust gas recirculation system of the present invention is relatively small and compact and therefore has improved "packaging" characteristics allowing engine designers greater freedom when positioning the EGR system of the present invention relative to other related engine components.

Other objects, features and advantages of the present invention will be readily appreciated as the same becomes better understood after reading the subsequent description taken in connection with the accompanying drawings.

DETAILED DESCRIPTION OF THE PREFERRED EMBODIMENT(S)

Figure 1:
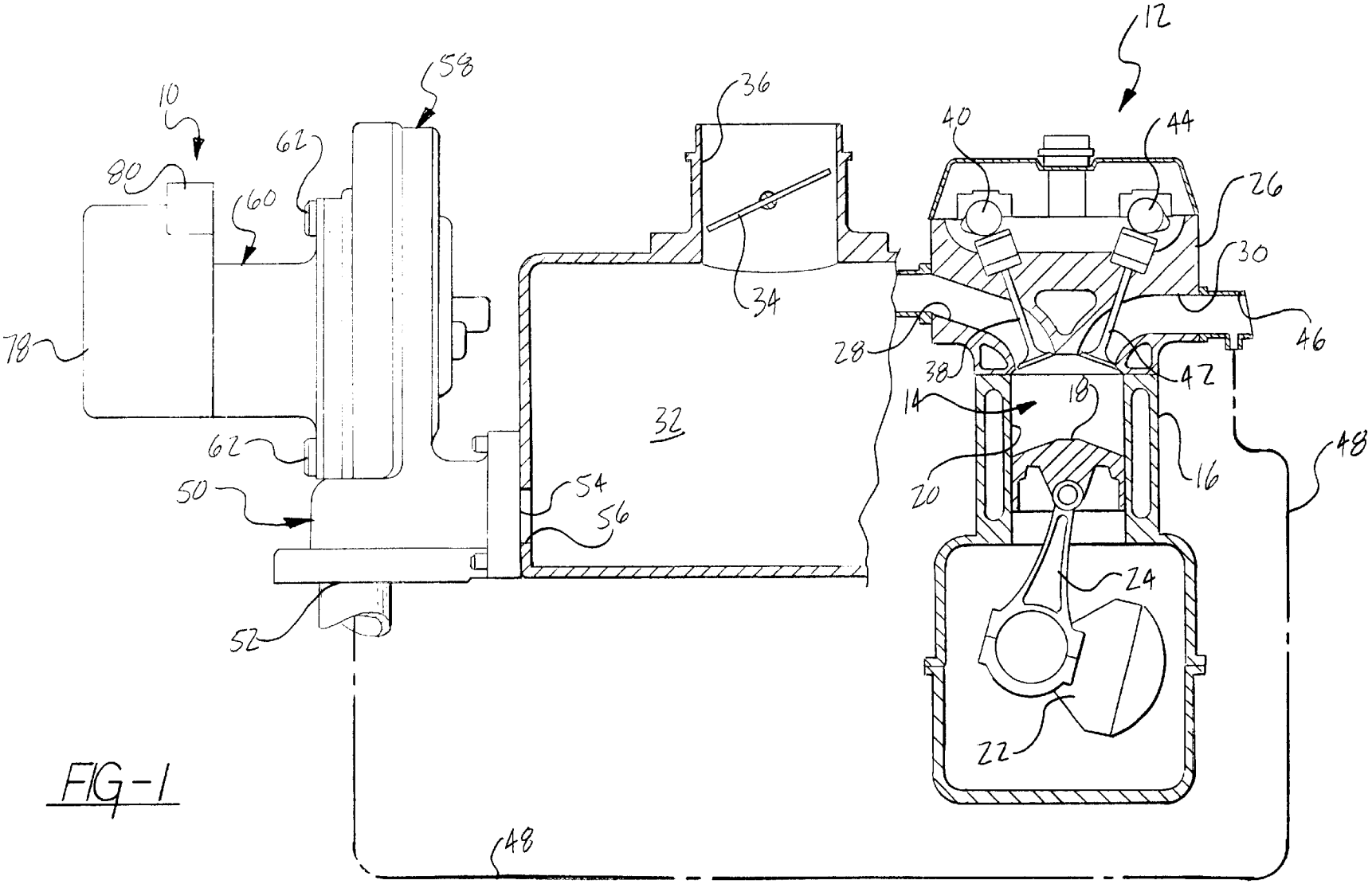
FIG. 1 is a schematic view of an internal combustion engine having the improved exhaust gas recirculation system of the present invention.

One embodiment of an exhaust gas recirculation system of the present invention is generally indicated at 10 in FIG. 1 and is shown in conjunction with a schematically illustrated internal combustion engine generally shown at 12. The internal combustion engine may include one or more combustion chambers arranged in any convenient manner such as in line or in a V-shaped configuration. Thus, the exhaust gas recirculation system 10 may be employed in conjunction with an internal combustion engine having a straight 4, straight 6, V-6, V-8, V-10 cylinder arrangements or the like. Furthermore, those having ordinary skill in the art will appreciate that the number and particular arrangement of the combustion chambers of the internal combustion engine form no part of the present invention. Thus, the internal combustion engine 12 is shown in FIG. 1 having one representative combustion chamber, generally indicated at 14, formed in an engine block 16. A piston 18 is supported for reciprocal motion within a cylinder 20. Together, the piston 18 and cylinder 20 define the combustion chamber 14. Reciprocal motion of the piston 18 in response to a combustion cycle in the cylinder 20 imparts rotary motion to a crankshaft 22 via the connecting rod 24 as is commonly known in the art.

A head 26 is mounted to the engine block 16 and includes at least one intake port 28 and at least one exhaust port 30. The intake port 28 is in fluid communication with an intake manifold, schematically represented at 32. Combustion air is drawn into the manifold 32 past a throttle 34 mounted in a throttle body 36 where it is mixed with partially atomized fuel vapor. The throttle 34 moves to adjust the opening of the throttle body 36 to adjust the amount of air flowing into the intake manifold 32 in response to certain predetermined parameters such as engine load, vehicle acceleration, etc. to regulate the air/fuel mixture to an optimum ratio.

In turn, the flow of the combustible air/fuel mixture into the cylinder 20 via the intake port 28 of the head 26 is controlled by one or more intake valves 38. The intake valves 38 may be supported in the head 26 for reciprocating motion under the influence of a cam shaft 40 to open and close fluid communication between the intake port 28 and the cylinder 20, as is commonly known in the art.

Similarly, an exhaust valve 42 may be supported in the head 26 for reciprocating motion under the influence of a cam shaft 44 to open and close fluid communication between the cylinder 20 and the exhaust port 30. When the exhaust valve 42 is open, the products of combustion, including exhaust gases having partially combusted pollutants such as $NO_x$, are communicated to an exhaust manifold 46 through the exhaust port 30 formed in the head 26.

Where it is desired that the amount of pollutants should be reduced, a portion of the exhaust gas may be drawn off from the exhaust manifold 46 or any other suitable location on the engine and communicated to the exhaust gas recirculation system 10. Fluid communication of exhaust gases from its source (the combustion cylinder 20) to the exhaust gas recirculation system 10 is schematically represented by the dotted line 48. Thus, those having ordinary skill in the art will appreciate that any suitable means for achieving this type of fluid communication may be employed without departing from the scope of the invention.

Figure 2:
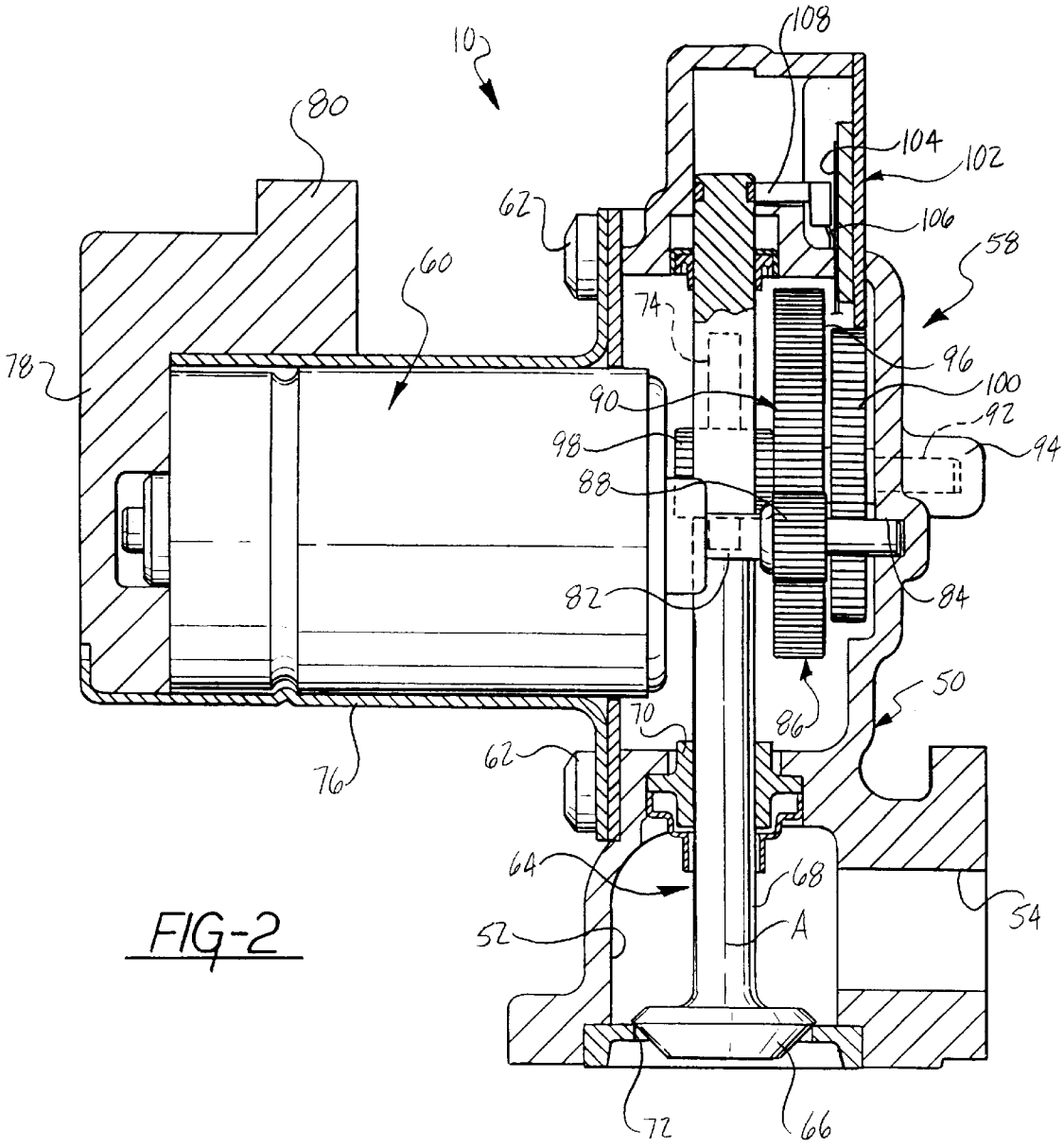
FIG. 2 is a cross-sectional side view of one embodiment of the exhaust gas recirculation system of the present invention.

Referring now to FIG. 1 in conjunction with FIG. 2, the exhaust gas recirculation system 10 is shown mounted at any convenient location on the engine 12 and is in fluid communication with both the intake manifold 32 and the exhaust manifold 46. To this end, the exhaust gas recirculation system 10 of the present invention includes a valve body, generally indicated at 50, having an exhaust port 52 which is adapted for fluid communication with a source of exhaust gas. In the embodiment illustrated in FIG. 1, this fluid communication is effected with the exhaust manifold 46 via one or more conduits represented by the dotted line 48. In addition, the valve body 50 includes an intake port 54 which is adapted for fluid communication with the intake manifold 32 of the internal combustion engine 12. In the embodiment illustrated in FIG. 1, the exhaust gas recirculation system 10 is mounted directly to the intake manifold 32 and communicates therewith via a passage 56. However, those having ordinary skill in the art will appreciate from the description which follows that the exhaust gas recirculation system 10 may be mounted at any convenient place on the engine 12. The valve body 50 may also include a gear train housing, generally indicated at 58, which may be formed integrally therewith or as a separate component which is fastened to other components to define the valve body 50. A drive member, generally indicated at 60, is mounted to the gear housing 58 of the valve body 50 using fasteners 62 or any other suitable means. The drive member 60 and gear housing 58 will be described in greater detail below.

The exhaust gas recirculation system 10 also includes a valve member, generally indicated at 64. The valve member 64 is movable between open and closed positions to control the flow of exhaust gas from the exhaust port 52 to the intake port 54 of the system 10. More specifically, the valve member 64 includes a valve element 66 and a valve stem 68 extending from the valve element 66 and through a bushing 70 in the valve body 50. The valve element 66 is received on a valve seat 72 formed in the valve body 50 at the exhaust port 52 when the valve member 64 is in its closed position. Above the bushing 70, the valve stem 68 includes gear teeth 74 formed on at least a portion thereof More specifically, the valve stem 68 defines a longitudinal axis A of the valve member 64. The gear teeth 74 define a rack extending for a predetermined distance along the length of the valve stem 68 in the direction of the longitudinal axis. The valve element 66 is movable from the closed position shown in FIGS. 2 and 3 to the open position shown in FIG. 4 in a direction toward the drive member 60 and parallel to the longitudinal axis A. Thus, in the embodiment disclosed in FIGS. 2 through 4, the exhaust gas recirculation system 10 employs a "pull to open" valve arrangement.

Figure 3:
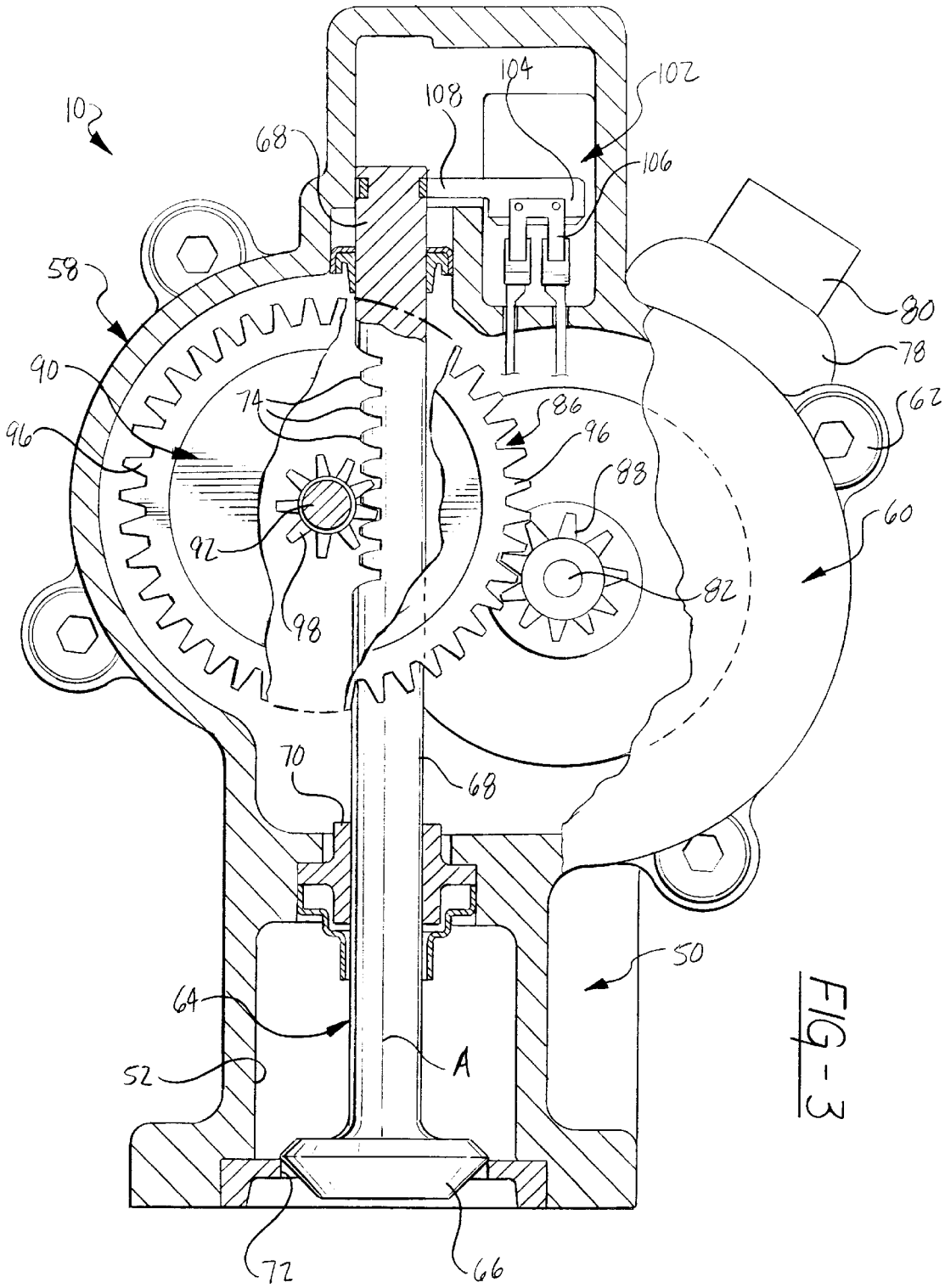
FIG. 3 is a cross-sectional front view of one embodiment of the exhaust gas recirculation system of the present invention.
Figure 4:
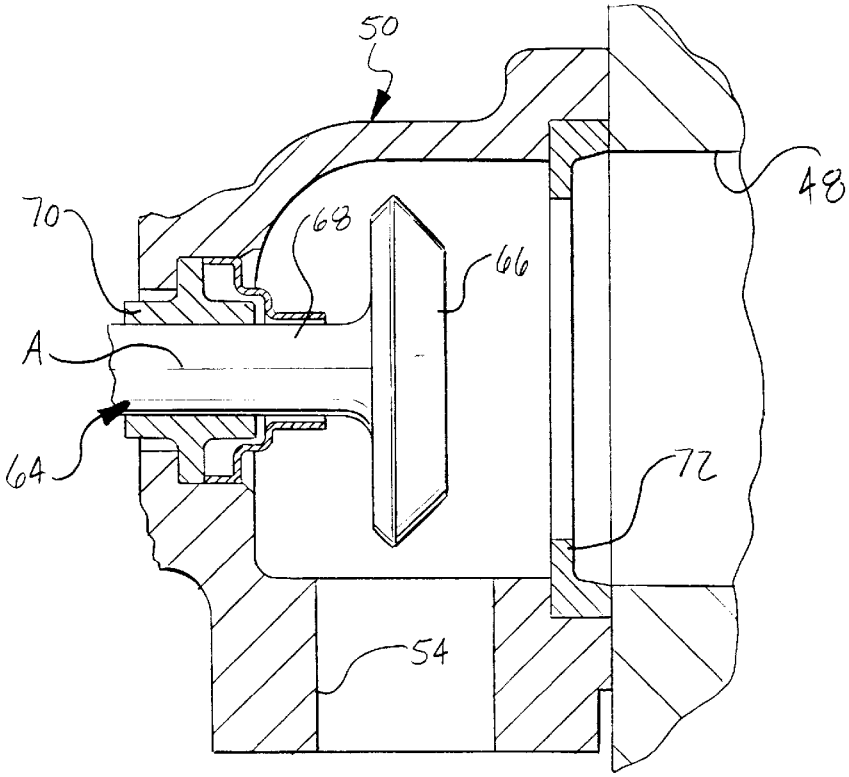
FIG. 4 is a partial cross-sectional side view of the valve member of one embodiment of the exhaust valve recirculation system of the present invention shown in its open position.

In the preferred embodiment illustrated in FIGS. 2–3, the drive member 60 is a permanent magnet electric motor operating on direct current. The motor 60 has a flanged housing 76 used to mount the motor 60 to the gear train housing 58 via the fastener 62 as mentioned above and a non-conductive, typically plastic, end cap 78 at one end thereof. The end cap 78 includes an electrical connector 80 integrally formed with the end cap 78. The electrical connector 80 is operatively adapted for connection with a source of electrical power (not shown). The electrical motor 60 has a mechanical output which is rotatable in opposed first and second directions. More specifically, the mechanical output includes a drive shaft 82 which is rotatable in both clockwise and counterclockwise directions. The drive shaft 82 is supported at its terminal end opposite the motor 60 in a boss 84 formed in the gear housing 58.

A gear train, generally indicated at 86, is supported within the gear housing 58. More specifically, the gear train 86 is operably disposed between, and in meshing engagement with, the drive shaft 82 of the motor 60 as well as the valve member 64 such that rotation of the drive shaft 82 in either of its first or second directions imparts linear, reciprocal motion directly to the valve member 64 through the gear train 86. In this way, the motor 60 through its drive shaft 82 and the gear train 86 directly moves the valve member 64 between its opened and closed positions to control the flow of exhaust gas from the exhaust port 52 to the intake port 54 and, ultimately, to the cylinders 20 of the internal combustion engine 12. To this end, the gear train 86 is operatively disposed between and in meshing engagement with the drive shaft 82 and the gear teeth 74 on the valve stem 68. More specifically, the gear train 86 includes a pinion drive gear 88 mounted for rotation with the drive shaft 82 and a compound gear, generally indicated at 90. The compound gear 90 is operatively disposed between and in meshing engagement with the pinion drive gear 88 and the gear teeth 74 of the valve stem 68. The compound gear 90 is mounted for rotation on a stub shaft 92 supported in a boss 94 formed in the gear housing 58. The compound gear 90 includes a reduction gear 96 and a pinion driven gear 98. The reduction gear 96 is in operative, meshing engagement with the pinion drive gear 88. The pinion driven gear 98 is in operative meshing engagement with the gear teeth 74 on the valve stem 68. The reduction gear 96 serves to reduce the rotational speed of the drive shaft 82 to an appropriate level for moving the valve member 64 between its open and closed positions. Thus, the gear train 86 acts to translate the rotary output of the drive shaft 82 directly into linear reciprocating movement of the valve member 64.

In the preferred embodiment, the compound gear 90 is an integral piece and the reduction gear 96 and the pinion driven gear 98 are therefore formed together. However, those having ordinary skill in the art will appreciate from the discussion which follows that the present invention is not limited to the specific gear train disclosed herein and that a number of different configurations may be employed to translate the rotary movement of the drive shaft 82 into the linear, reciprocal movement of the valve member 64.

The exhaust gas recirculation system 10 further includes a biasing member 100, shown in FIG. 2, which acts on the valve member 64 to bias the valve element 66 in a direction away from the motor 60 and toward its closed position. In the preferred embodiment, the biasing member is a rotary spring 100 but those having ordinary skill in the art will appreciate that any suitable biasing means may be employed.

The exhaust gas recirculation system 10 further includes a sensor, generally indicated at 102, which accurately monitors the position and movement of the valve member 64. The sensor 102 may include a linear stroke sensor or potentiometer having a wiper 104 which is fixably mounted in the valve body 50. The sensor 102 further includes at least one pickup 106 which is operatively mounted to or otherwise connected with the valve stem 68 of the valve member 64. In the embodiment illustrated in FIGS. 2–3, a bridge 108 operatively interconnects the pick-up 106 of the valve stem 68. Accordingly, the pickup 106 is adapted for linear, reciprocal movement with valve member 64. At the same time, the pickup 106 is in physical, sliding contact with the wiper 104 such that the position and movement of the valve member 64 is detected as the valve member 64 is moved between its open and closed positions.

Thus, based on certain predetermined parameters such as engine load, throttle positions, acceleration, etc. the motor 60 is energized on command by an engine control module (ECM). Actuation of the motor 60 causes rotation of the drive shaft 82 in one direction or the other resulting in immediate and direct actuation of the valve member 64 via the gear train 86 to its open or closed positions. As it moves, the position of the valve member 64 is at all times monitored by the position sensor 102 which feeds this information back to the ECM.

Figure 7:
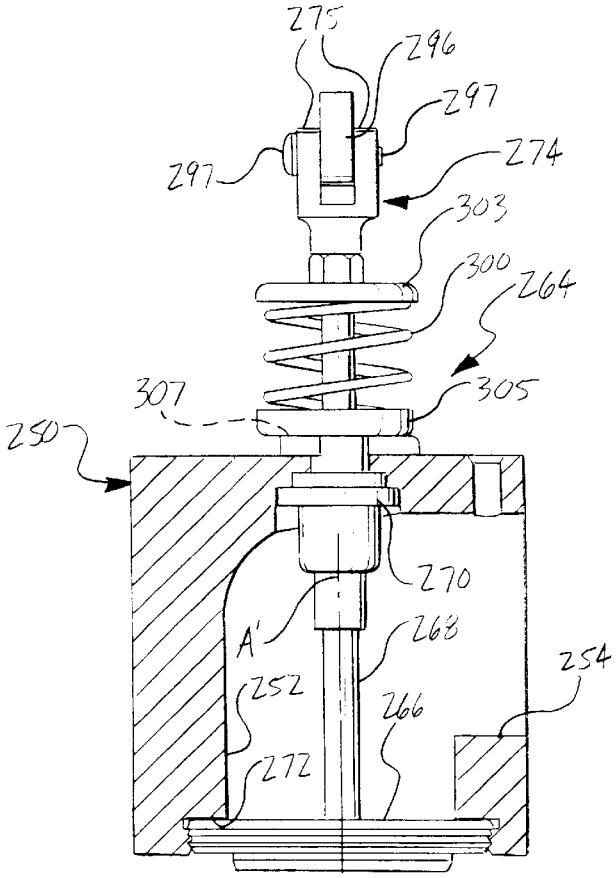
FIG. 7 is a partial, cross-sectional side view illustrating the valve member of the alternate embodiment of the present invention with the valve member shown in its closed position.
Figure 5:
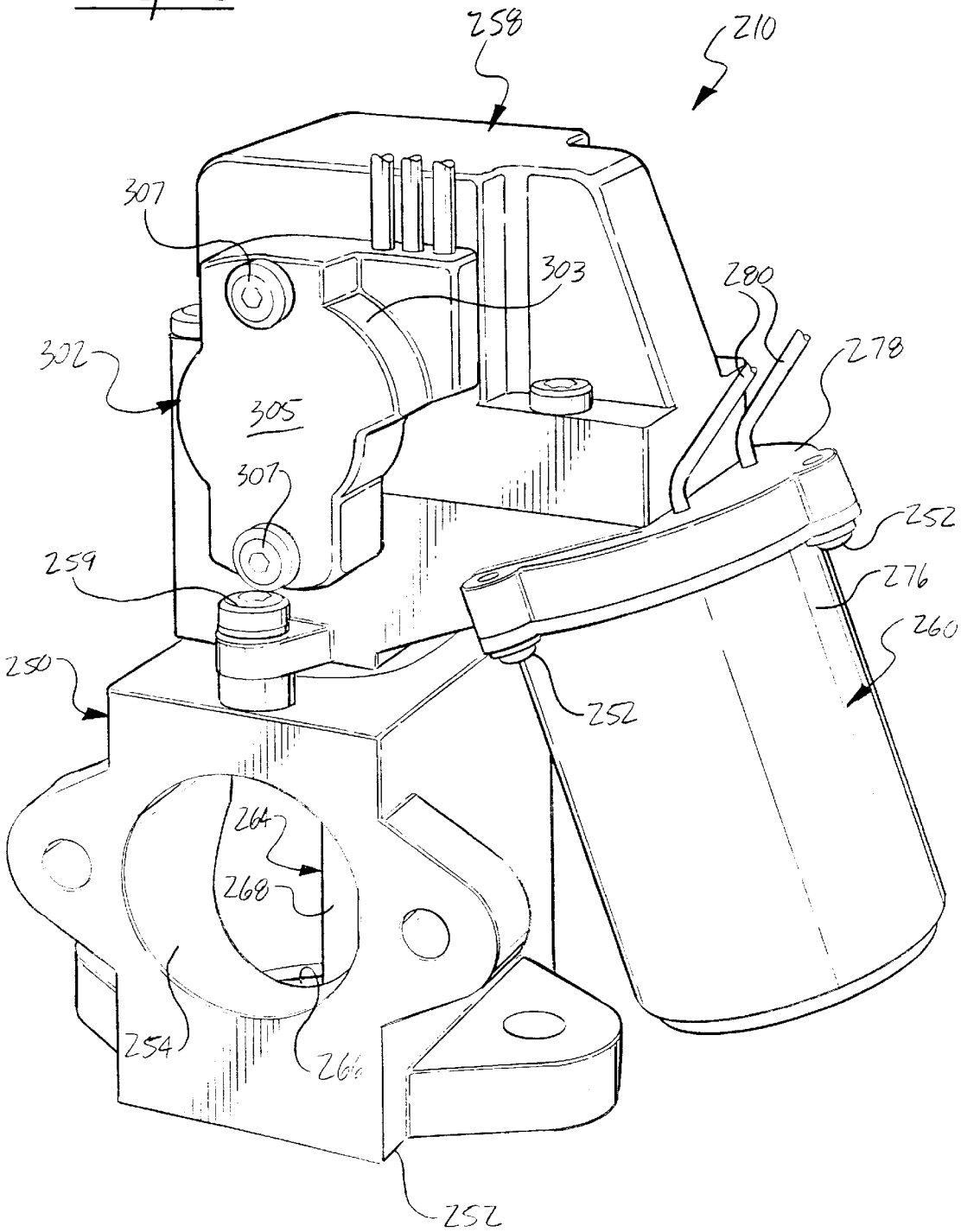
FIG. 5 is a perspective view of an alternate embodiment of the exhaust gas recirculation system of the present invention.
Figures 6, 6A:
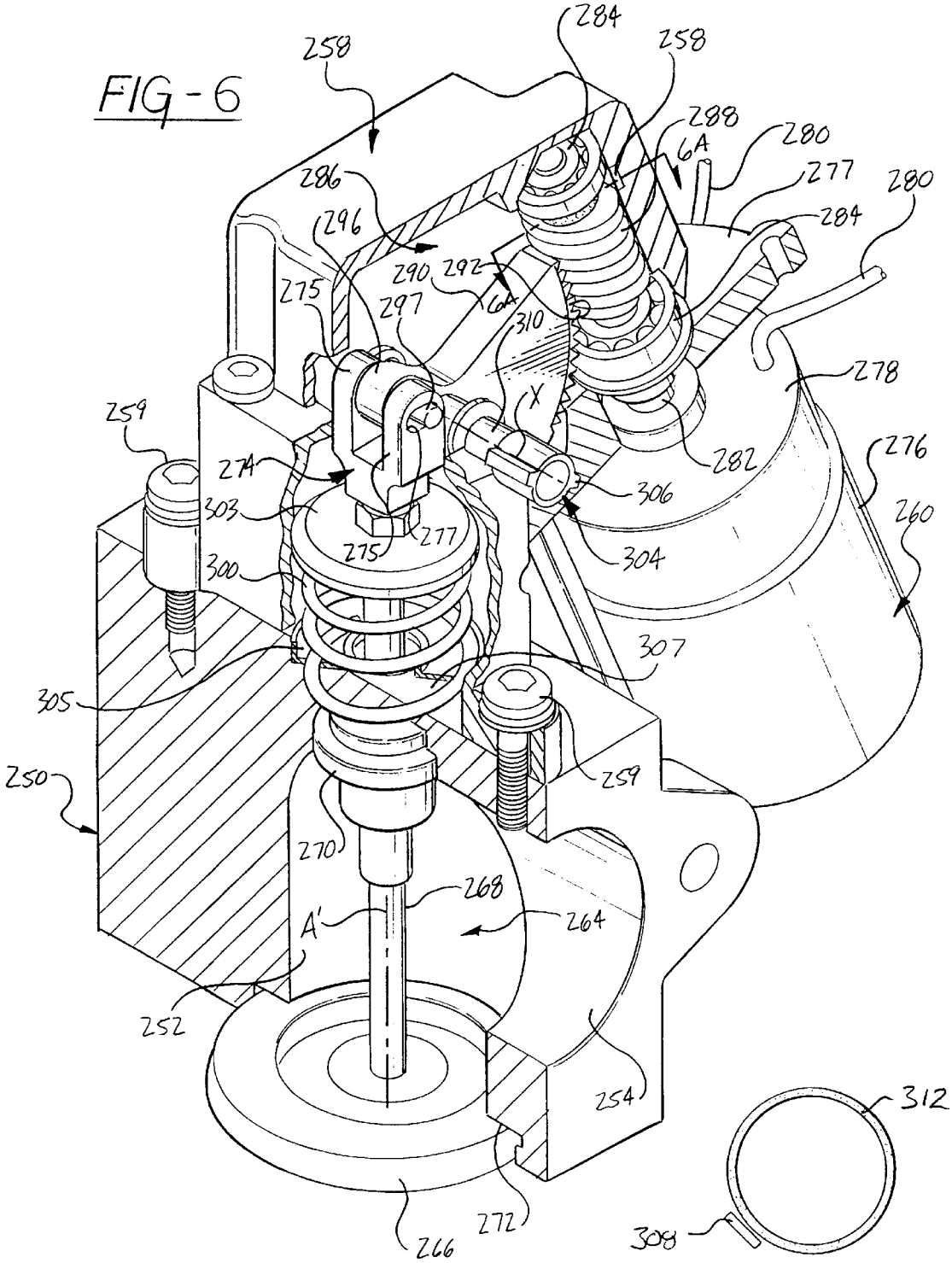
FIG. 6 is a partial perspective view of the alternate embodiment of the exhaust gas recirculation system of the present invention with portions of the valve body broken away to illustrate the gear train and valve member.
FIG. 6A is a cross-sectional view taken along lines 6A—6A of FIG. 6.

An alternate embodiment of the exhaust gas recirculation system of the present invention is generally indicated at 210 in FIGS. 5 and 6 where like numerals, increased by a factor of 200, are used to designate like structure throughout FIGS. 5 through 7. As with the exhaust gas recirculation system 10 illustrated in FIGS. 2 through 4, the exhaust gas recirculation system 210 is adapted to be used in connection with an internal combustion engine of the type schematically illustrated in FIG. 1. Accordingly, the discussion of the operation of the engine 12, the purpose of an exhaust gas recirculation system and its location relative to other components of the engine 12 are incorporated herein by reference as if repeated in connection with the discussion directed toward the exhaust gas recirculation system 210 of FIGS. 5–7 which follows.

The exhaust gas recirculation system 210 includes a valve body 250 having an exhaust port 252 adapted for fluid communication with a source of exhaust gas and an intake port 254 adapted for fluid communication with the intake manifold 32 of the internal combustion engine. Like the embodiment illustrated in FIG. 1, the exhaust gas recirculation system 210 is adapted to be mounted directly to the intake manifold 32 and communicates therewith via the passage 56. However, those having ordinary skill in the art will appreciate from the description which follows that the exhaust gas recirculation system 210 may be mounted at any convenient place on the engine.

The valve body 250 may also include a gear train housing, generally indicated at 258, which may be formed integrally therewith or as a separate component which is mounted to other components via fasteners 259, or the like, to define the valve housing 250. In addition, the exhaust gas recirculation system 210 includes a drive member, generally indicated at 260, which is mounted to the gear housing 258 of the valve body 250 using fasteners 252 or any other convenient means. The drive member 260 and gear housing 258 will be described in greater detail below.

The exhaust gas recirculation system 210 further includes a valve member, generally indicated at 264. The valve member 264 is movable between open and closed positions to control the flow of exhaust gas from the exhaust port 252 to the intake port 254. More specifically, the valve member 264 includes a valve element 266, a yoke, generally indicated at 274, and a valve stem 268 extending therebetween. The valve element 266 is received on a valve seat 272 formed in the valve body 250 at the exhaust port 252. Furthermore, the valve member 264 includes a valve stop 270 formed about the valve stem 268 and which cooperates with the valve body 250 to limit movement of the valve member 264 in the direction of the closed positions as will be described in further detail below.

The valve stem 268 defines a longitudinal axis A' of the valve member 264. The valve element 266 is movable from its closed position as illustrated in FIGS. 6 and 7 to an open position in a direction away from the drive member 260 and parallel to the longitudinal axis A' of the valve member 264. The exhaust gas recirculation system 210 also includes a biasing member 300 which acts on the valve member 264 to bias the valve element 266 in a direction toward the drive member 260 (upwardly as illustrated in FIGS. 6 and 7) and toward its closed position. A spring retainer 303 encircles one end of the valve stem 268 adjacent the yoke 274. In the preferred embodiment illustrated in FIGS. 6 and 7, the biasing member is a coiled spring 300. The spring 300 is disposed between the retainer 303 and a complementary retainer 305 supported on a surface 307 of the valve body 250. The coiled spring 300 acts on the valve member 264 through the retainer 303 in the direction of the closed positions of the valve member 264.

In the preferred embodiment illustrated in FIGS. 5–7, the drive member is a permanent magnet, electric motor 260 operating on direct current. The motor 260 has a flanged housing 276 used to mount the motor 60 to a motor mount 277 (FIG. 6) of the valve body 250 as mentioned above and a non-conductive, typically plastic, end cap 278 at one end thereof. The end cap 278 includes electrical connectors 280 which are used to supply the motor with power. The electrical motor 260 has a mechanical output which is rotatable in opposed first and second directions. More specifically, the mechanical output includes a drive shaft 282 which is rotatable in clockwise and counterclockwise directions.

The exhaust gas recirculation system 210 further includes a gear train, generally indicated at 286, which is supported within the gear housing 258. More specifically, the gear train 286 is operatively disposed between and in engagement with the drive shaft 282 of the motor 260 and the valve member 264 such that rotation of the drive shaft 282 in either of its first or second directions imparts linear, reciprocal motion directly to the valve member 264 through the gear train 286. In this way, the valve member 264 is moved between open and closed positions to control the flow of exhaust gas from the exhaust port 252 to the intake port 254. To this end, the gear train 286 is operatively disposed between the drive shaft 282 and the yoke 274 on the valve element 266. More specifically, the gear train 286 includes a worm drive gear 288 mounted within the gear housing 258 between two roller bearings 284. The worm drive gear 288 is coupled for rotation with the drive shaft 282 of the motor 260. The gear train 286 also includes a sector gear 290 having arcuately disposed gear teeth 292. The sector gear 290 is rotatable about an axis X extending transverse to the longitudinal axis of the valve member 264. Furthermore, the sector gear 290 includes a lever portion 296 which is operatively coupled to the yoke 274 and through which linear reciprocating movement is imparted to the valve member 264.

More specifically, the yoke 274 has a pair of tines 275 extending upwardly as illustrated in FIG. 6 and in the direction of the longitudinal axis of the valve member 264. The tines 275 are spaced from one another and include oval shaped apertures 277 extending through each tine 275. The lever portion 296 is received between the tines 275 and includes a pair of opposed cylindrical bosses 297 extending in a direction transverse to the longitudinal axis of the valve member 264. The cylindrical bosses 297 are received in the oval shaped apertures 277 thereby interconnecting the lever portion 296 of the sector gear 290 directly to the valve member 264 via the yoke 274. Rotational movement of the sector gear 270 causes the lever portion 296 to act on the yoke 274 to import linear, reciprocating movement to the valve member 264 to move it between its open and closed positions.

The exhaust gas recirculation system 210 further includes a sensor, generally located at 302 in FIG. 5, which is integrated into the valve body 250 and is operatively interconnected with the valve member 264 for detecting the linear position of the valve member 264 as it is reciprocally moved between its open and closed positions. In the preferred embodiment, the sensor is a potentiometer having a housing 303 with cover plate 305 operatively mounted to the housing 303 via fasteners 307 or the like. As best shown in FIG. 6, the sector gear 290 includes stub axle 310 which is coextensive with and rotatable about the transverse axis. The sensor 302 is operatively interconnected to the stub axle 310 in the area of 304 through drive tangs 306. Detection of rotary movement of the stub axle 310 may be used to determine the linear movement of the valve member 264 between its open and closed positions. In the preferred embodiment illustrated in FIG. 6A, the sensor 308 is a non-contacting, Hall effect sensor. This consists of a ring magnet 312 mounted on a hub which, in turn, may be mounted on the worm drive gear 288 or any other convenient location. The ring magnet 312 is magnetized with multiple poles around its circumference. The hall sensor 308 is in close proximity to the OD of the magnet 312 and mounted on housing 258. Linear movement of the valve member 264 is sensed through movement at the worm drive gear.

Based on certain predetermined parameters such as engine load, throttle position, acceleration, etc., the motor 260 is energized on command by an engine control module (ECM). Actuation of the motor 260 causes rotation of the drive shaft 282 in one direction or the other resulting in immediate and direct actuation of the valve member 264 via the gear train 286 to its open or closed position. As it moves, the position of the valve member 264 is at all times monitored by the position sensor 302 which feeds this information back to the ECM.

Thus, the exhaust gas recirculation system 10, 210 provides accurate, incremental control of the movement of the valve member 64 with a much faster response time when compared with vacuum actuated EGR valves. Furthermore, the exhaust gas recirculation system 10, 210 enjoys very precise valve positioning capabilities which are highly repeatable. The system 10, 210 results in an elimination of a number of components found in conventional EGR valves such as the electrically actuated vacuum regulator having a diaphragm used to actuate a valve member, the pressure sensor as well as the associated on-board plumbing typically employed in connection with vacuum actuated EGR systems known in the related art. Thus, the exhaust gas recirculation system 10, 210 of the present invention is smaller and more compact than vacuum actuated EGR valves known in the related art. This results in improved "packaging" characteristics which allow engine designers greater freedom when positioning the exhaust gas recirculation system of the present invention relative to other related components.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

We claim:

1. An exhaust gas recirculation system for an internal combustion engine, said system comprising:

a valve body having an exhaust port adapted for fluid communication with a source of exhaust gas, an intake port adapted for fluid communication with the intake manifold of an internal combustion engine, and a valve member, said valve member having a valve element and a valve stem extending from said valve element, said valve stem including gear teeth formed on at least a portion thereof defining a longitudinal rack extending for a predetermined distance along the length of said valve stem;

a drive member mounted to said valve body and including a drive shaft having a mechanical output rotatable in opposed first and second directions;

a gear train operably disposed between, and in engagement with, said drive shaft and said gear teeth on said valve stem such that said mechanical output rotating in either of said first or second directions imparts linear, reciprocal motion directly to said valve member through said gear train thereby moving said valve member between open and closed positions to control the flow of exhaust gas from said exhaust port to said intake port; and a sensor integrated into said valve body and operatively connected to said valve member for detecting the linear position of said valve member as said valve member is reciprocally moved between said open and closed positions.

2. An exhaust gas recirculation system as set forth in claim 1 wherein said gear train includes a pinion drive gear mounted for rotation with said drive shaft of said drive member and a compound gear operatively disposed between and in meshing engagement with said pinion gear and said gear teeth of said valve stem.

3. An exhaust gas recirculation system as set forth in claim 2 wherein said compound gear includes a reduction gear and a pinion driven gear, said reduction gear being in operative meshing engagement with said pinion drive gear and said pinion driven gear being in operative meshing engagement with said gear teeth on said valve stem to translate said rotary output of said drive shaft into linear reciprocating movement of said valve member.

4. An exhaust gas recirculation system as set forth in claim 1 wherein said valve element is movable from said closed position to said open position in a direction toward said drive member and parallel to said longitudinal axis.

5. An exhaust gas recirculation system as set forth in claim 4 further including a biasing member acting on said valve member to bias said valve element in a direction away from said drive member and toward said closed position.

6. An exhaust gas recirculation system as set forth in claim 5 wherein said biasing member is a rotary spring acting on said valve member in the direction of said closed position.

7. An exhaust gas recirculation system as set forth in claim 1 wherein said drive member is a permanent magnet electrical motor operating on direct current and mounted to said valve body and said rotatable mechanical output includes a drive shaft rotatable in clockwise and counter-clockwise directions.

8. An exhaust gas recirculation system as set forth in claim 1 wherein said sensor includes a linear stroke sensor having a wiper fixedly mounted in said valve body and a pick-up operatively mounted to said valve stem and adapted for linear reciprocal movement therewith, said pick-up being in physical sliding contact with said wiper such that the position and movement of said valve member is detected as said valve member is moved between said open and closed positions.

* * * * *